US006146166A

United States Patent [19]

Muzslay

[11] Patent Number: 6,146,166

[45] **Date of Patent: *Nov. 14, 2000**

[54] SPRING PIN CONTACT ASSEMBLY

[75] Inventor: Steven Zoltan Muzslay, Huntington Beach, Calif.

[73] Assignee: ITT Manufacturing Enterprises, Inc., Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 09/096,827

[22] Filed: Jun. 12, 1998

[51] Int. Cl.[7] ..... H01R 29/00

[52] U.S. Cl. ..... 439/176; 439/825

[58] Field of Search ..... 439/825, 628, 439/176, 891

[56] References Cited

U.S. PATENT DOCUMENTS

| | | | |
|---|---|---|---|
| 1,975,467 | 10/1934 | Livingston | 173/328 |
| 2,269,779 | 1/1942 | Morten | 173/334.1 |
| 2,313,307 | 3/1943 | Wilkinson | 210/62 |
| 3,350,500 | 10/1967 | Ziegler, Jr. | 174/89 |
| 3,659,247 | 4/1972 | Chaney et al. | 339/21 |
| 3,759,623 | 9/1973 | Hesse | 403/298 |
| 3,852,704 | 12/1974 | Muz | 339/252 |
| 3,897,131 | 7/1975 | Stauffer | 439/655 |
| 4,093,389 | 6/1978 | Wibrow | 403/280 |
| 4,820,207 | 4/1989 | Zic | 439/825 |
| 5,632,655 | 5/1997 | DeMarco et al. | 439/655 |
| 5,823,256 | 10/1998 | Moore | 16/65.1 |

*Primary Examiner*—Lincoln Donovan
*Assistant Examiner*—Brian S. Webb
*Attorney, Agent, or Firm*—Thomas L. Peterson

[57] ABSTRACT

An electrical connector assembly (10) is provided for connecting a pair of devices (12, 14) that have precision flat surfaces (20, 22) that lie facewise against each other. Each device has socket contacts (30, 32, 34, 36) with a socket contact end lying slightly inward of the corresponding precision surface, and a spring pin contact (40, 42) fits into each pair of sockets to electrically connect them. The spring pin contact is formed from a piece of sheet metal that is bent into a sleeve that has opposite end portions (80, 82) and a middle portion (84). Each end portion forms at least three radially-outward projections (86, 88) for providing large area engagement with the corresponding socket inside surface. The socket contacts preferably compress the sleeve so its edges (94, 96) abut one another.

12 Claims, 2 Drawing Sheets

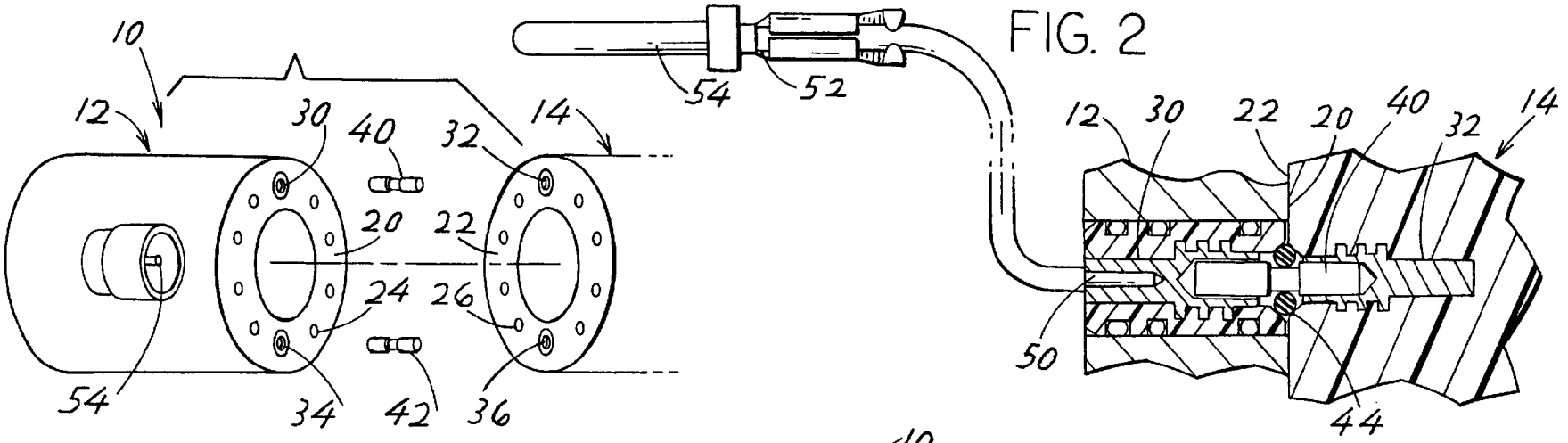
FIG. 2
FIG. 1
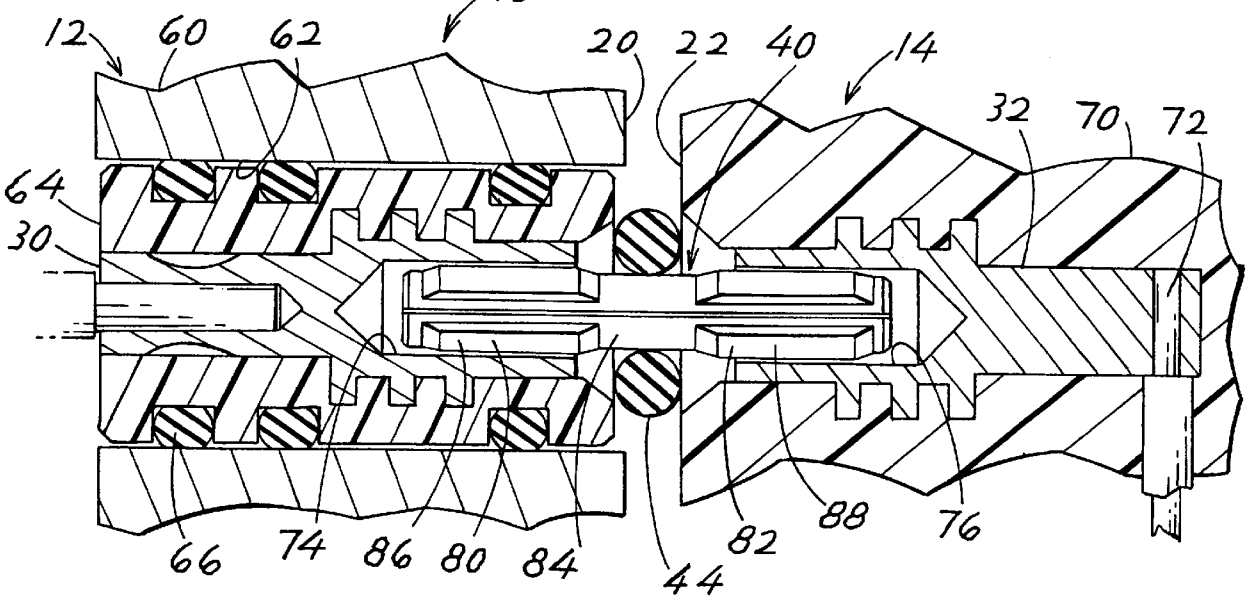
FIG. 3

SPRING PIN CONTACT ASSEMBLY

BACKGROUND OF THE INVENTION

Diesel engines commonly include a fuel injector system that injects fuel under a high pressure (e.g. over 100 psi) into cylinders. The fuel injector assembly may include a steel fuel injector and an actuator, that have precision flat surfaces that lie facewise against one another. Passages in the fuel injector and the actuator are aligned to pass pressured fuel, and a pair of electrical contacts passes large current (e.g. peaks of over 10 amperes) between them. One previous way for making disengagable electrical connections was to form pin contacts on one device and socket contacts on the other device. However, the pin contacts make it difficult to refinish the surface as by grinding and polishing it, since the pin contacts are in the way of grinding and polishing equipment. Apparatus for connecting a pair of devices which allowed the contacts on the two devices to lie recessed from the precision surfaces, would be of value.

SUMMARY OF THE INVENTION

In accordance with one embodiment of the present invention, a connector assembly is provided, which includes first and second devices that contain first and second electrical socket contacts, and a spring pin contact that can connect the socket contacts of the two devices. The spring pin contact is in the form of a sleeve formed from sheet metal that has been rolled into a largely cylindrical tubular shape. The sleeve has opposite end portions with radially outward projections thereat that engage the walls of the socket passages. The socket contacts and sleeve are preferably constructed so the edges of the sleeve, which extend parallel to the axis of the sleeve, are pressed into contact with each other, to provide high contact passage over a large area, for high current flow capacity.

The novel features of the invention are set forth with particularity in the appended claims. The invention will be best understood from the following description when read in conjunction with the accompanying drawings.

BRIEF DESCRIPTION OF THE DRAWINGS

FIG. 1 is an exploded isometric view of a connector assembly of the present invention.

FIG. 2 is a sectional view of the spring pin contact and socket contacts of the connector assembly of FIG. 1, with the two electrical devices of FIG. 1 shown fully mated.

FIG. 3 is an enlarged view of a portion of FIG. 2, but with the devices not fully mated.

DESCRIPTION OF THE PREFERRED EMBODIMENTS

Figure 5:
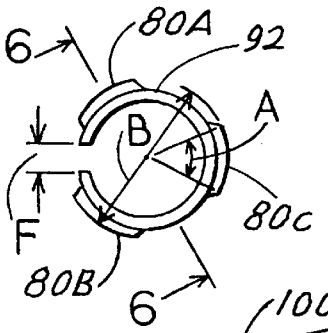
FIG. 5 is an end view of the spring pin contact of FIG. 4.

FIG. 1 illustrates a connector assembly 10 which includes first and second devices 12, 14 that are to be mechanically and electrically connected. The first device 12 is a fuel injector for a diesel engine, while the second device 14 is an actuator. The two devices have adjacent precision flat surfaces 20, 22 which are pressed tightly together to connect the devices. The devices have a series of precisely aligned holes or bores 24, 26, and diesel fuel at high pressure passes through the bores. The first device has a pair of electrical contacts 30, 34 which are connected to corresponding electrical contacts 32, 36 of the second device. A pair of spring pin contacts or sleeves 40, 42 connect the contacts of the two devices. The particular contacts 30–36 are socket contacts, which each can receive an end portion of a corresponding sleeve 40, 42.

The faces 20, 22 of the two devices are made precisely flat as by grinding and polishing the surfaces. After a period of use, if the surfaces 20, 22 become corroded or otherwise degraded, they must be refinished, as by again grinding and polishing them. Previously, one pair of contacts such as 30, 34 had projecting pins for engaging the corresponding sockets 32, 36. Projecting pins at 30, 34 made it more difficult to precisely finish the surface 20. Applicant's use of spring pin contacts in the form of sleeves 40, enables all contacts 30–36 lying in the devices, to be slightly recessed from the corresponding surfaces 20, 22. The pin contacts or sleeves 40, 42 can be readily removed when the surfaces are to be refinished. It is noted that, although the sleeves 40, 42 have a small diameter which may be less than 2 mm, they must pass relatively high currents, such as 12 ampere spikes, and are generally rated for a current-carrying capacity of at least 20 amperes. Such high current capacity requires good contact over large areas between the sleeves and socket contacts.

FIG. 2 shows the two devices 12, 14 with their surfaces 20, 22 facewise engaged with each other. An O-ring 44 lies compressed between the two devices, and the sleeve 40 connects the two socket contacts 30, 32. One of the socket contacts 30 is shown crimped to a wire 50 which has an opposite end 52 that is crimped to a pin contact 54.

FIG. 3 shows that the first device 12 includes a steel housing 60 with a bore 62. An insulator 64 lies within the bore, and the first contact 30 is molded into the insulator, which assures good sealing. O-rings 66 seal the insulator to the walls of the bore 62. The second device 14 has a molded housing 70, and a second socket contact 32 is molded therein. A wire 72 is shown connected to an end of the second socket contact.

Each of the socket contacts 30, 32 forms a passage 74, 76 which is designed to receive an end portion 80, 82 of the sleeve 40. The sleeve also has a middle portion 84, and the O-ring 44 lies around the middle portion. Each of the end portions has a plurality of projections 86, 88 that provide large area contact with the walls of the socket passages 74, 76.

Figure 4:
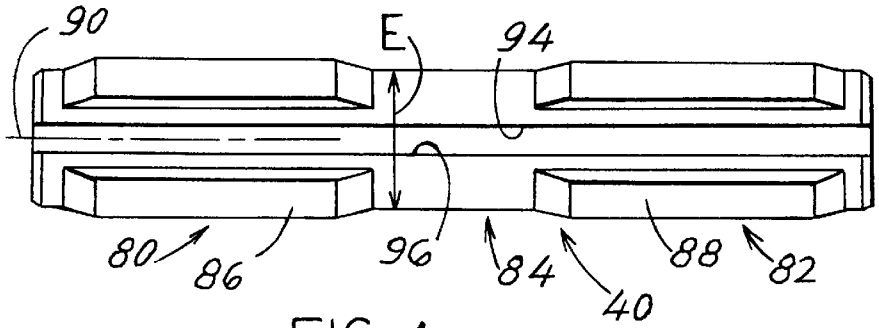
FIG. 4 is a side elevation view of the spring pin contact of FIG. 3, but with the spring contact uncompressed.
Figure 6:
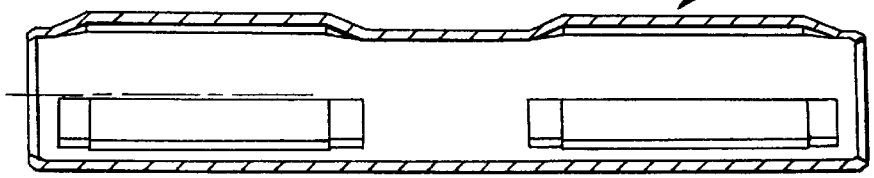
FIG. 6 is a sectional view taken on line 6—6 of FIG. 5.

As shown in FIGS. 4–7, a spring pin contact or sleeve 40 is formed of sheet metal that has been bent about an axis 90 into a largely cylindrical tubular or sleeve-like shape. However, prior to bending, the piece of sheet metal has been plastically deformed to form three projections at each end portion, such as projections 80A, 80B and 80C. Each of the projections extends radially outwardly (relative to axis 90) with respect to surrounding areas such as 92 of the sleeve. Applicant prefers to form three projections, that are circumferentially wide, in that each subtends an angle A that is preferably at least 30° as viewed along the axis 90, with the particular projections having outer surfaces subtending angles that are 50°. The three projections self center themselves while assuring that each projection contacts the walls of the socket. If four or more projections are used, then at least one may not engage the socket walls, while only two contacts provides less reliable engagement. As shown in FIG. 4, each of the projections 80 preferably has a length parallel to the axis 90 that is greater than the outside diameter B of the sleeve. When the piece of sheet metal has been rolled into a tubular shape, it has adjacent edges 94, 96 that are primarily parallel to each other and to the axis 90. The inside diameter C (FIG. 7) of each socket contact such as 30, is small enough that it radially compresses the sleeve.

Figure 7:
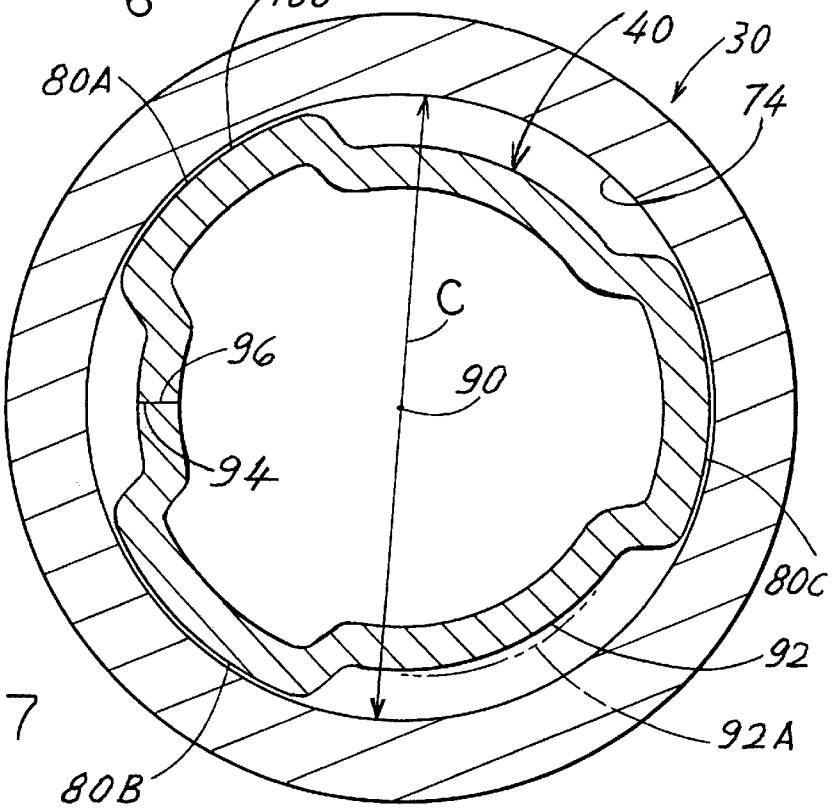
FIG. 7 is an enlarged sectional view taken on line 7—7 of FIG. 4, but with the spring pin contact lying fully compressed within a socket contact.

Applicant constructs the sleeve 40 and socket contacts such as 30 so the sleeve is highly compressed. Applicant prefers that the sleeve is sufficiently compressed so, as shown in FIG. 7, the adjacent edges 94, 96 of the sleeve are pressed against each other. Due to tolerances, the adjacent edges will not be engaged along the entire length of the sleeve, but they are engaged at at least one point within each socket contact. The engagement of the sleeve edges 94, 96, results in the outer surfaces 100 of the projections 80A, 80B, 80C pressing with large force against the inside surface 74 of the corresponding socket contact. Such large force results in wide area engagement between the projection outer surfaces 100 and the socket contact inner surface 74. The large area of contact enables large currents, such as over 10 amperes to be transmitted between the sleeve and socket contact without creating "hot" spots that are heated due to low area contact and consequent high resistance. Surrounding areas 92 of the sleeve can deflect, as to the position 92A, to account for slight tolerances that can result in slightly greater sleeve compression at one location than necessary for engagement of the edges 94, 96, although the parts are formed with high precision to minimize over compression. The outer surfaces 100 of the projections have the same radius of curvature (from axis 90) as the inside surfaces 74 of the socket contacts.

In an electrical connector apparatus that applicant has designed, the sleeve was formed of a copper alloy of high resilience and strength, and was nickel plated to avoid corrosion. A beryllium-copper alloy can be used for high strength. Applicant prefers that the sleeve material and especially the projection outer surfaces, be highly electrically conductive; that is, that they have a higher conductivity than stainless steel (type 304 has a resistivity of 72 microhm-cm) or iron (resistivity of 67 microhm-cm). The spring pin contact (FIG. 5) had an outside diameter B (assuming circumferential extension of a projection 80C) of 0.075 inch (1.90 mm) and a diameter E at the middle portion 84 of 0.60 inch (1.52 mm), all prior to compression. The axial length of the sleeve was 0.36 inch (9.14 mm). Each of the projections was constructed so its outer surface had an axial length of 0.1 inch (2.54 mm) and a circumferential width of 0.025 inch (0.63 mm). The gap length F was initially 0.20 inch (0.5 mm) but was designed to be closed when installed in one of the socket contacts.

Thus, the invention provides an electrical connector assembly that includes a pair of devices with socket contacts that are recessed from a precision surface, and a spring pin contact in the form of a sleeve that can fit into both socket contacts to electrically connect them. The sleeve is formed of sheet metal that has been rolled into a tubular shape, with adjacent edges that extend largely parallel to the axis of the tube, with opposite end portions and with a middle portion. Each of the end portions has a plurality of radially outward projections, with the number of projections preferably being three and with each projection preferably subtending an angle of at least 30°. The socket contacts and sleeve are preferably formed so the sleeve is compressed until the adjacent edges of the sleeve contact each other.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. The combination of a pair of sockets with passages forming cylindrical inner socket surfaces, and electrical connector apparatus with opposite end portions that each can fit into one of said sockets to electrically connect the sockets, comprising:

a sheet metal sleeve that has opposite end portions each lying in one of said sockets, and that has an axis;

said sleeve having an outer surface forming only three radially-outward projections at each of said opposite end portions for engaging one of said sockets, with the three outward projections being spaced approximately equally about said axis, and with a circumferential gap of a plurality of degrees between adjacent projections and with each projection having an outer surface area curved substantially about said axis and extending a plurality of degrees about said axis, and with each projection outer surface area lying in facewise contact with one of said socket inner surfaces along a plurality of degrees about said axis.

2. The electrical apparatus described in claim 1, wherein:

said sleeve is formed of a single piece of sheet metal that has been rolled into a largely cylindrical shape, with said piece of sheet metal having adjacent edges that extend generally parallel to each other;

said passages are of a size that results in said edges of said sleeve abutting each other.

3. The electrical apparatus described in claim 1 wherein:

each of said projections subtends an angle of at least 30° about said axis.

4. Electrical connector apparatus with axially opposite end portions that each can fit into one of a pair of cylindrical sockets to electrically connect the sockets, comprising:

a piece of sheet metal which is bent into a sleeve that has opposite end portions and that has an axis, with adjacent edges of the sleeve extending generally parallel to said axis;

said sleeve having an outer surface forming a plurality of radially-outward projections at each of said opposite end portions, with each of said projections having a radially outer surface that is curved about a circle that is centered on said axis, along an angle of a plurality of degrees about said axis, and with a gap of a plurality of degrees between projections, as viewed along said axis, to provide large areas of contact between said projections and said sockets.

5. The electrical apparatus described in claim 4 wherein:

said sleeve has a middle portion lying between said end portions, with said middle portion being substantially devoid of said projections.

6. The electrical apparatus described in claim 4 including said cylindrical sockets, wherein:

each of said sockets has a cylindrical passage for receiving one of said end portions of said sleeve;

said passages are aligned and said sleeve lies with each of said sleeve end portions in a different one of said passages;

said passages are of a size that results in said edges of said sleeve abutting each other.

7. The electrical apparatus described in claim 4 wherein:

said plurality of radially outward projections at each end portion consists of three projections uniformly spaced about said axis at each of said end portions.

8. The electrical apparatus described in claim 4 wherein:

each of said projections has a radially outer circular surface that subtends an angle of at least 30° about said axis.

9. A connector assembly comprising;

first and second devices that contain first and second electrical socket contacts that each has walls forming a largely cylindrical socket passage with an entrance end that lies nearest the other socket contact, said devices being oriented with said socket passages aligned;

a metal sleeve of largely cylindrical shape with an axis, said sleeve having opposite end portions each lying in a different one of said socket passages;

each sleeve end portion having a plurality of radially outward projections that engage said passage walls and said sleeve having a middle portion that is of smaller outside diameter than said end portions and that lies between said end portions and within said entrance ends;

an O-ring of elastomeric material lying around said sleeve middle portion and compressed between said entrance ends so the O-ring axial length is reduced, with said O-ring sealed to said entrance ends.

10. The assembly described in claim 9 wherein:

said sleeve is formed of a piece of sheet metal that has been rolled into a cylindrical shape about said axis and with adjacent sheet metal edges extending primarily parallel to said axis;

each sleeve end portion has a plurality of radially outward projections that engage the inner walls of the corresponding socket passage and has nonprojecting parts connecting said projections, as viewed along said axis, said socket passages are of a size to compress said sleeve so said adjacent edges of said sleeve abut each other.

11. The apparatus described in claim 1 wherein:

said sleeve has an outer diameter and each of said projections has an axial length that is greater than said sleeve outer diameter.

12. The apparatus described in claim 4 wherein:

said sleeve has an outer diameter and each of said projections has an axial length that is greater than said sleeve outer diameter.

* * * * *